US005864791A

United States Patent [19]

Lee

[11] Patent Number: 5,864,791

[45] Date of Patent: Jan. 26, 1999

[54] PITCH EXTRACTING METHOD FOR A SPEECH PROCESSING UNIT

[75] Inventor: See-Woo Lee, Seoul, Rep. of Korea

[73] Assignee: Samsung Electronics Co., Ltd., Kyungki-Do, Rep. of Korea

[21] Appl. No.: 808,661

[22] Filed: Feb. 28, 1997

[30] Foreign Application Priority Data

Jun. 24, 1996 [KR] Rep. of Korea ..... 1996 23341

[51] Int. Cl.[6] ..... G10L 9/00

[52] U.S. Cl. ..... 704/207; 704/219

[58] Field of Search ..... 704/207, 208, 704/211, 216, 217, 219, 223

[56] References Cited

U.S. PATENT DOCUMENTS

| | | | |
|---|---|---|---|
| 4,701,954 | 10/1987 | Atal | 704/216 |
| 4,845,753 | 7/1989 | Yasunaga | 381/38 |
| 5,091,944 | 2/1992 | Takahashi | 704/219 |
| 5,189,701 | 2/1993 | Jain | 381/41 |
| 5,657,419 | 8/1997 | Yoo et al. | 704/223 |
| 5,680,426 | 10/1997 | Ching-Ming | 378/8 |

FOREIGN PATENT DOCUMENTS

| | | | |
|---|---|---|---|
| 0 712 116 | 11/1994 | European Pat. Off. | G10L 3/00 |
| WO 87/01498 | 3/1987 | WIPO | G10L 3/00 |

*Primary Examiner*—David R. Hudspeth
*Assistant Examiner*—Susan Wieland
*Attorney, Agent, or Firm*—Sughrue, Mion, Zinn, Macpeak & Seas, PLLC

[57] ABSTRACT

A method of extracting at least one pitch from every frame of a speech signal, which includes the steps of generating a number of residual signals revealing high and low points of the speech signal within a frame, and taking one of those residual signals which satisfies a predetermined condition among the generated residual signals, as the pitch. In the step of generating the residual signals, the speech is filtered using a FIR-STREAK filter which is a combination of the finite impulse response (FIR) filter and a STREAK filter, and the filtration result is output as the residual signal. In the step of generating the pitch, only the residual signal whose amplitude is over a predetermined value, and the residual signal whose temporal interval is within a predetermined period of time is generated as the pitch.

8 Claims, 6 Drawing Sheets

IPP; INDIVIDUAL PITCH PULSE

PITCH EXTRACTING METHOD FOR A SPEECH PROCESSING UNIT

BACKGROUND OF THE INVENTION

1. Field of the Invention

This invention relates to a method for extracting a speech pitch during processes, such as encoding and synthesizing speech processes. More specifically, it relates to a pitch extracting method which is efficient in extracting the pitch of sequential speech.

2. Description of the Related Art

As demand for a communication terminal rapidly increases with the development of scientific techniques, the typical communication line cannot handle the capacity needed to support such a communication terminal. To solve this problem, methods have been provided for encoding speech at a bit rate below 8 kilobits/second (kbit/s). When processing speech according to those encoding methods, however, a problem of tone quality deterioration occurs. Many investigators are doing wide-ranging studies for the purpose of improving tone quality while processing speech with a low bit rate.

In order to improve tone quality, psychological properties such as musical interval, sound volume, and timbre must be improved. At the same time, physical properties corresponding to the psychological properties, such as pitch, amplitude, and waveform structure, must be reproduced close to the corresponding properties in the original sound. The pitch is called a "fundamental frequency" or "pitch frequency" in a frequency domain, and is called a "pitch interval" or a "pitch" in a spatial domain. Pitch is an indispensable parameter in judging a speaker's gender and distinguishing between a voiced sound and a voiceless sound of uttered speech, especially, when encoding speech in a low bit rate.

At present, three major methods are available for extracting the pitch, namely, a spatial extracting method, a method of extracting in the frequency domain, and a method of extracting in the spatial domain and the frequency domain. An autocorrelation method is representative of the spatial extracting method, the Cepstrum method is representative of a method for extracting in the frequency domain, and an average magnitude difference function (AMDF) method and a method in which a linear prediction coding (LPC) and AMDF are combined are representative methods for extracting in the spatial domain and frequency domain.

In the above conventional methods, a speech waveform is reproduced by applying a voiced sound to every interval of a pitch which is repeatedly reconstructed when processing speech after being extracted from a frame of speech data, where a frame of speech data corresponds to scores of milliseconds of the speech data. In real sequential speech, however, vocal chord or sound properties are changed when a phoneme varies, and the pitch interval is delicately altered by interference even in a frame of scores of milliseconds of the speech data. In the case where neighboring phonemes influence each other, so that speech waveforms which have different frequencies exist together in one frame of sequential speech, an error occurs in extracting the pitch. For example, an error in extracting the pitch occurs at the beginning or end of speech, a transition of the original sound, a frame in which mute and voiced sound exist together, or a frame in which a voiceless consonant and a voiced sound exist together. As described above, the conventional methods are vulnerable to sequential speech problems.

SUMMARY OF THE INVENTION

Accordingly, an object of the present invention is to provide a method of improving speech quality while processing speech in a speech processing unit.

Another object is to provide a method of removing an error which occurs when extracting speech pitch in the speech processing unit.

A further object of the present invention is to provide a method of efficiently extracting the pitch of the sequential speech.

In order to achieve the above objects, the present invention is provided with a method of extracting at least one pitch from every predetermined frame.

The present invention is directed to a method of extracting a speech pitch from a frame of a speech signal in a speech processing unit, comprising: generating a plurality of residual signals from the speech signal, wherein each generated residual signal indicates one of a high and a low point of the speech signal within the frame; and generating the pitch of the speech signal by selecting one of the generated plurality of residual signals as the pitch, wherein the selected residual signal satisfies a predetermined condition. Generating the plurality of residual signals comprises filtering the speech signal using a finite impulse response (FIR)-STREAK filter, wherein said FIR-STREAK filter is a combination of a FIR filter and a STREAK filter; and outputting a result of filtering the speech signal as the residual signal. Furthermore, generating the pitch of the speech signal comprises selecting as the pitch a residual signal having an amplitude greater than a predetermined value, and having a temporal interval within a predetermined period of time. Moreover, at least one pitch is extracted from each one of a plurality of predetermined frames.

The present invention is also directed to a method of extracting a pitch from a frame containing a sequential speech signal in a speech processing unit having a finite impulse response (FIR)-STREAK filter which is a combination of a FIR filter and a STREAK filter, the method comprising: filtering the sequential speech signal of the frame using the FIR-STREAK filter; generating residual signals from the filtered sequential speech signal, wherein the generated residual signals satisfy a predetermined condition; interpolating residual signals of the frame other than the generated residual signals of the frame with reference to residual signals of another frame, thereby generating interpolated residual signals; and extracting, as the pitch, one of the generated residual signals and the interpolated residual signals.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE PREFERRED EMBODIMENT

With reference to the attached drawings, a preferred embodiment is described below in detail.

The sequential speech for thirty-two sentences uttered by four Japanese announcers are used as examples of speech data in describing the present invention (see Table 1).

TABLE 1

| Factor | Speaker | Speaking time (seconds) | Number of simple sentences | Number of vowels | Number of voiceless consonants |
|---|---|---|---|---|---|
| Male | 4 | 3.4 | 16 | 145 | 34 |
| Female | 4 | 3.4 | 16 | 145 | 34 |

Figure 1:
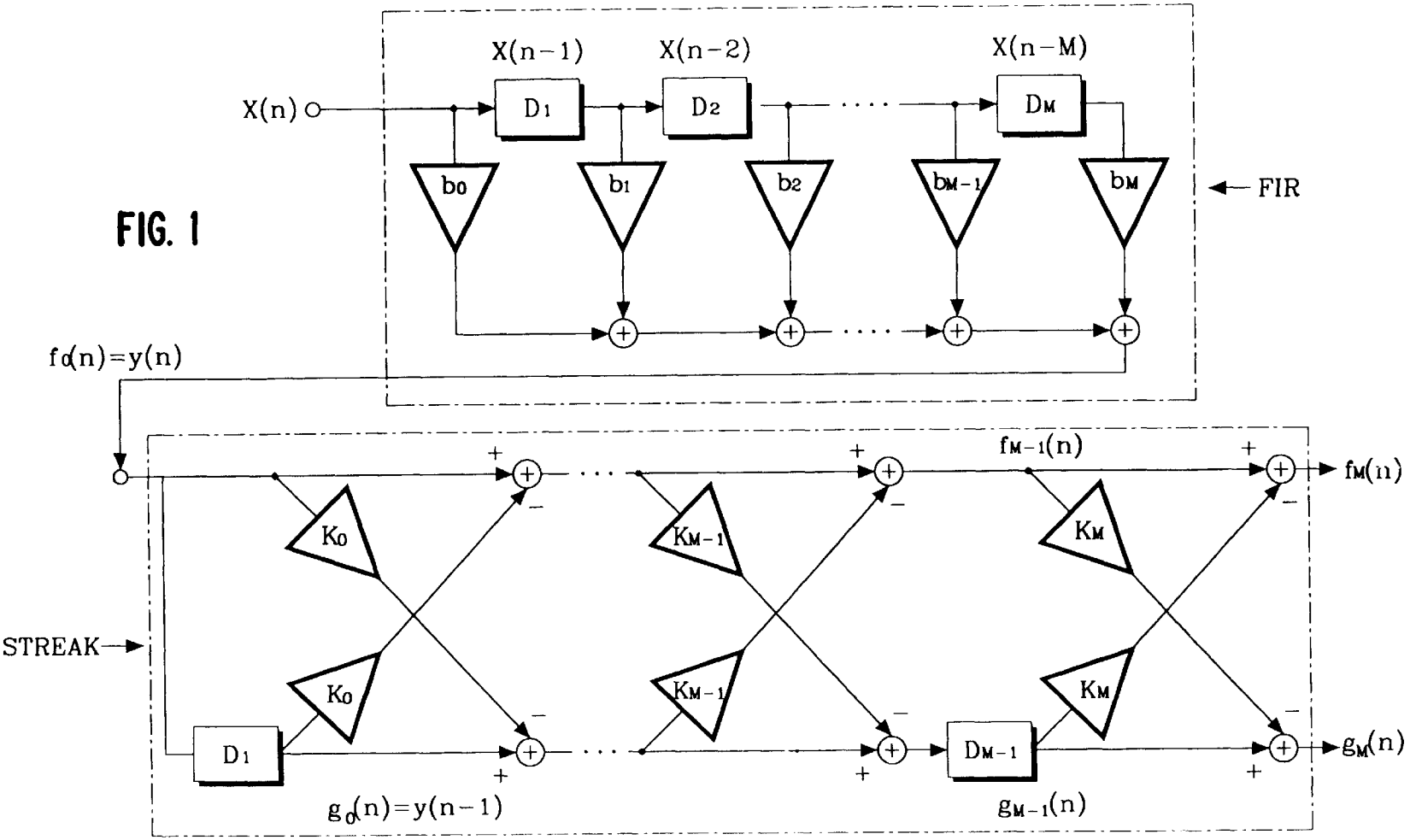
FIG. 1 is a block diagram showing the construction of an FIR-STREAK filter according to the present invention.
Figure 2A:
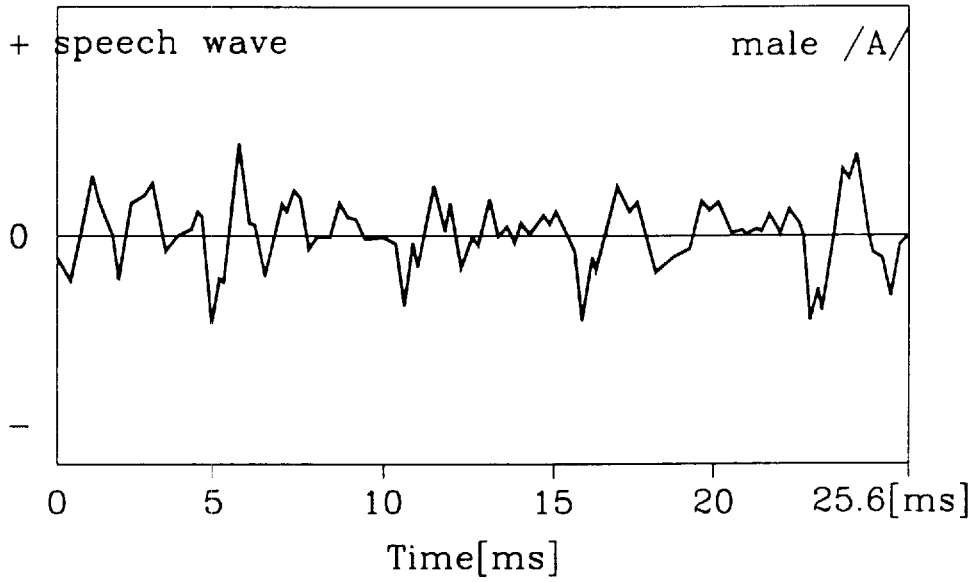
FIGS. 2A–2D show waveforms of residual signals generated through the FIR-STREAK filter.
Figure 2B:
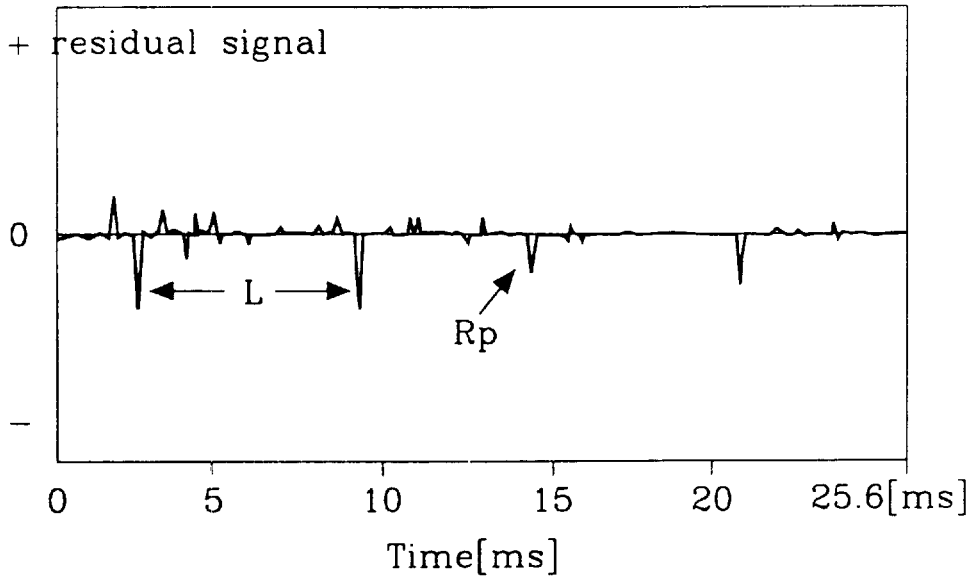
Figure 2C:
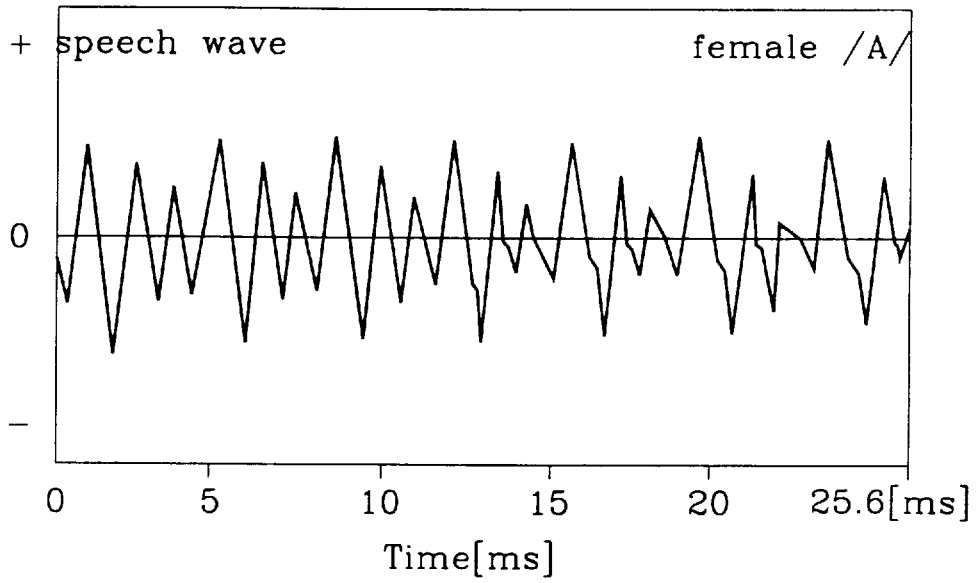
Figure 2D:
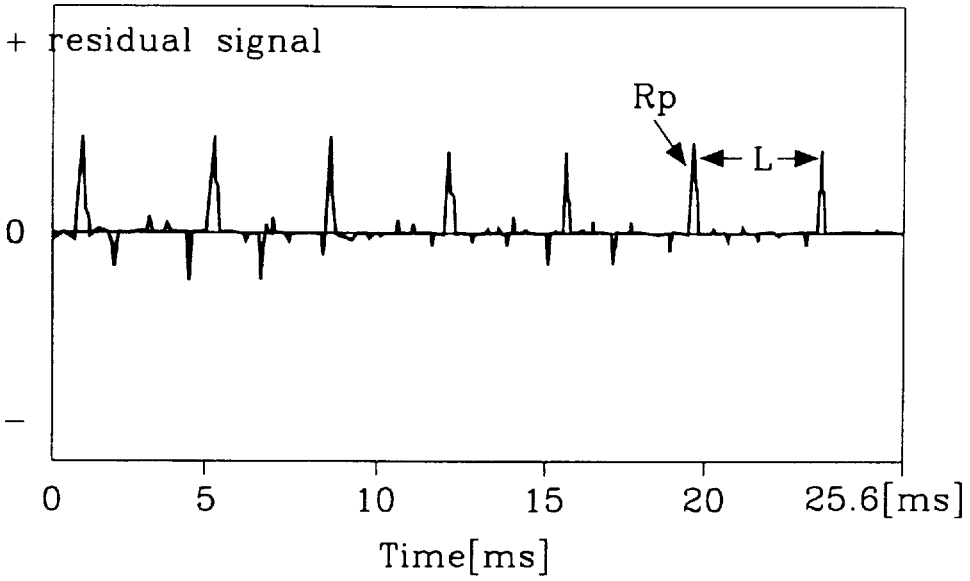

With reference to FIGS. 1 and 2A–2D, a FIR-STREAK filter generates resultant signals $f_M(n)$ and $g_M(n)$ which result from filtering an input speech signal X(n). In the case where the speech signals shown in FIGS. 2A and 2C are input, the FIR-STREAK filter outputs residual signals such as those shown in FIGS. 2B and 2D, respectively. A residual signal Rp, which is necessary to extract a pitch, is obtained from the FIR-STREAK filter. The pitch obtained from the residual signal Rp is referred to hereinafter as an "individual pitch pulse (IPP)".

A STREAK filter is expressed according to formula (1), set forth below, formed with a front error signal $f_i(n)$ and a rear error signal $g_i(n)$.

$$\begin{aligned} AS &= f_i(n)^2 + g_i(n)^2 \\ &= -4k_i \times f_{i-1}(n) \times g_{i-1}(n-1) + (1+k_i)^2 \times [f_{i-1}(n)^2 + g_{i-1}(n-1)^2] \end{aligned} \tag{1}$$

A STREAK coefficient of formula (2) set forth below is obtained by partial-differentiating formula (1) with respect to $k_i$.

$$ki = \frac{2 \times f_{i-1}(n) \times g_{i-1}(n-1)}{[f_{i-1}(n)^2][g_{i-1}(n-1)]^2} \tag{2}$$

The following formula (3) is a transfer function for the FIR-STREAK filter.

$$Hs(z) = \frac{\sum_{i=0}^{MF} b_i z^{-1}}{\sum_{i=0}^{MS} k_i z^{-1}} \tag{3}$$

The variables MF and $b_i$ in formula (3) are the degree and coefficient of the FIR filter, respectively. The variables MS and $k_i$ are the degree and coefficient of the STREAK filter, respectively. Consequently, the Rp signal, which is the key to the IPP, is output from the FIR-STREAK filter.

Generally, there are three or four formants in the frequency band limited by a 3.4 kHz low pass filter (LPF). In a lattice filter, filter degrees from 8 to 10 are generally utilized in order to extract the formant. If the STREAK filter according to the present invention has a filter degree ranging from 8 to 10, the residual signal Rp will be clearly output. In the present invention, a STREAK filter of 10 degrees is preferably utilized. In the present invention the degree of the FIR filter, Mp, is preferably within the range $10 \leqq Mp \leqq 100$, and a band limited frequency Fp is preferably within the range 400 Hz$\leqq$Fp$\leqq$1 kHz, considering the fact that the pitch frequency band is 80 to 370 Hz, so that the residual signal Rp can be output.

According to the results of this experimentation, when Mp and Fp are 80 degrees and 800 Hz, respectively, the residual signal Rp clearly appears in the position of the IPP. At the beginning or ending of the speech signal, however, the Rp signal tends not to clearly appear. This indicates that the pitch frequency is greatly influenced by the first formant at the beginning or ending of the speech signal.

Figure 3A:
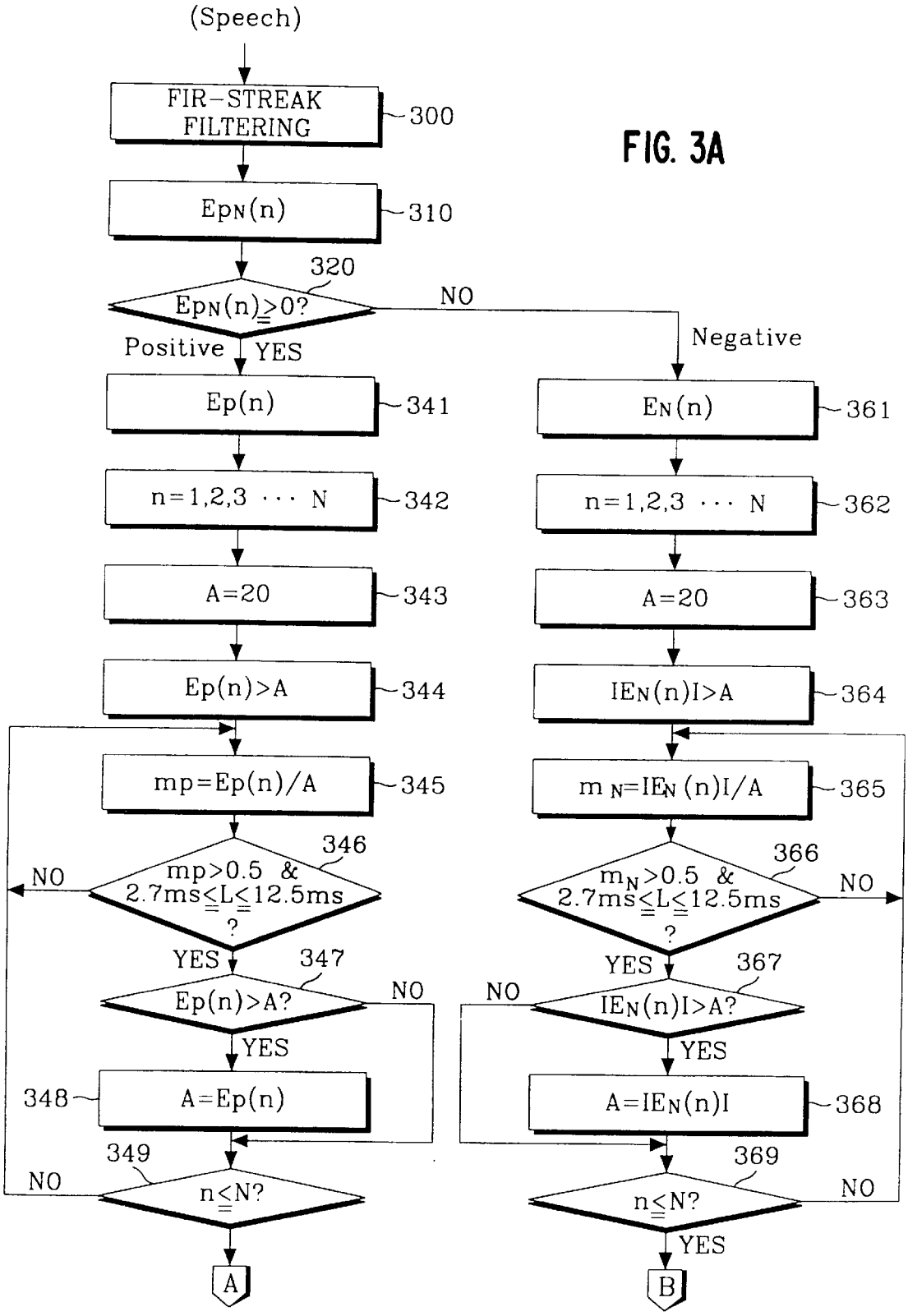
FIGS. 3A and 3B are flow charts showing a pitch extracting method according to the present invention.
Figure 3B:
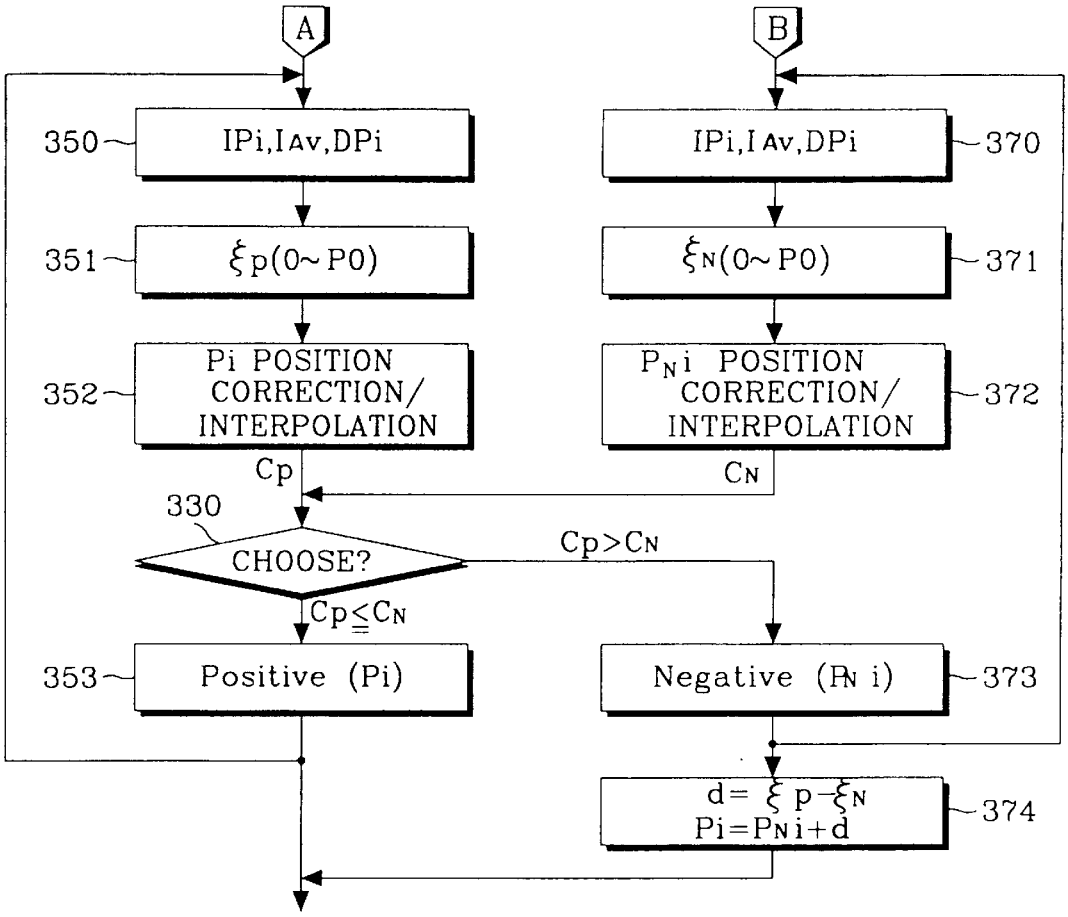

With reference to FIGS. 3A and 3B, the pitch extracting method according to the present invention is largely organized into three steps.

The first step 300 filters one frame of the speech signal using the FIR-STREAK filter.

The second step (from steps 310 to 349 or from steps 310 to 369) outputs a number of residual signals after selecting a signal, among the signals filtered by the FIR-STREAK filter, which satisfies a predetermined condition.

The third step (from steps 350 to 353, or from steps 370 to 374) extracts a pitch from the generated residual signals, and the residual signal is corrected and interpolated with reference to its relation with the preceding and succeeding residual signals.

In FIG. 3A, since the same processing methods are utilized in order to extract the IPP from $E_N(n)$ and $E_P(n)$, the description below will be limited to the method of extracting IPP from $E_P(n)$.

The amplitude of $E_P(n)$ is regulated according to a value "A" (steps 341–345), where the value of A is obtained by sequentially substituting the residual signals having large amplitudes (steps 347–349). A value $m_P$ is determined based on the exemplary speech data set forth above. As shown in step 345 the value of $m_P$ is calculated by dividing $E_P(n)$ by A.

At the Rp the value of $m_P$ is over 0.5. Consequently, a residual signal satisfying the conditions $E_P$ (n)>A and $m_P$>0.5 is arranged as Rp, and the position of Rp whose interval L, based on the pitch frequency, satisfies the condition 2.7 ms$\leqq$L$\leqq$12.5 ms, is arranged as the position of the IPP ($P_i$, i=0,1, . . . , M), where $P_0$–$P_M$ are the IPP positions within the frame (steps 346–349).

In order to correct and interpolate an omission of the Rp position (step 352), first as shown in FIG. 3B, $I_B$(=N–$P_M$+$\xi_P$) must be obtained based on $P_M$ which the last IPP position of the previous frame, and $\xi_P$ which expresses the time interval from 0 to $P_0$ in the present frame (steps 350–351). Then, in order to prevent a half pitch or a double pitch of an average pitch, the $P_i$ position must be corrected when an interval between $I_B$s is 50% or 150% of the average pitch interval ({$P_0$+$P_1$+ . . . +$P_M$}/M).

In the Japanese language, in which a vowel immediately follows a consonant, however, the following formula (4) is applied in the case where there is a consonant in the previous frame, and the formula (5) is applied in the case where there are no consonants in the previous frame.

$$0.5 \times I_{A1} \geqq I_B,\ I_B \geqq 1.5 \times I_{A1} \tag{4}$$

$$0.5 \times I_{A2} \geqq I_B,\ I_B \geqq 1.5 \times I_{A2} \tag{5}$$

Here, $I_{A1}=(P_M-P_0)/M$ and $I_{A2}=\{I_B+(P_M-P_i)\}/M$

The interval of IPP ($IP_i$), the average interval ($I_{AV}$), and a deviation ($DP_i$) of the intervals are obtained through the following formula (6), but $\xi_P$ and the interval between the end of the frame and $P_M$ are not included in $DP_i$. The position correction and interpolation operations are performed in step 357 through the following formula (7) in the case of $0.5 \times I_{AV} \geqq IP_i$ or $IP_i \geqq 1.5 \times I_{AV}$.

$$IP_i - P_i - P_{i-1} \tag{6}$$

-continued $$I_{AV} = (P_M - P_O)/M$$

$$DP_i - I_{AV} - IP_i$$

$$Pi = \frac{P_{i-1} + P_{i+1}}{2} \quad (7)$$

Here, i=1,2, . . . M.

The $P_i$ at which the position correction and interpolation operation are performed is obtained by applying formula (4) or (6) to $E_N(n)$. One of the $P_i$ on the positive side and negative side of the time axis which is obtained through such a method, must be chosen. Here, the $P_i$ whose position does not change rapidly is chosen in step 330 because the pitch interval in the frame scores of milliseconds in duration, changes gradually. In other words, the change of the $P_i$ interval against $I_{AV}$ is assessed through formula (8) set forth below, and then the $P_i$ on the positive side is chosen in the case where $C_P \leqq C_N$, and the $P_i$ on the negative side is chosen in the case where $C_P > C_N$. Here, $C_N$ is an assessed value obtained from $P_N(n)$ as set forth in formula (8).

$$C_p = \sum_{i=1}^{M} \frac{IPi}{IAV} \quad (8)$$

By choosing one of the $P_i$ on the positive and negative sides, however, there occurs a time difference, $(\xi_P - \xi_N)$ which is calculated in step 374. In the case where the negative $P_i$ ($PN_i$) is chosen in order to compensate for this difference, the position is recorrected in step 374 according to the following formula.

$$P_i = PN_i + (\xi_P - \xi_N) \quad (9)$$

Figure 4A:
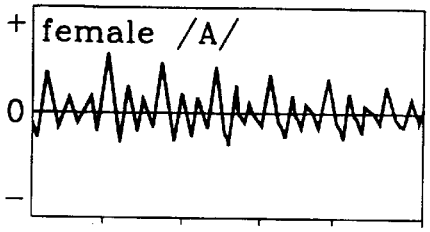
FIGS. 4A–4L show waveform charts of a pitch pulse extracted according to the method of the present invention.
Figure 4B:
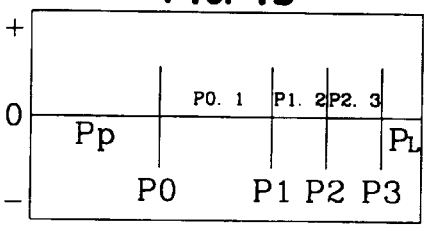
Figure 4C:
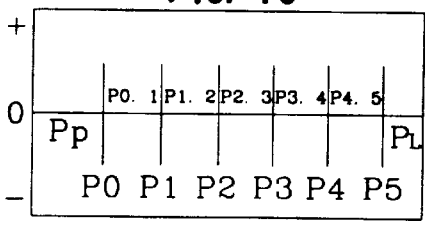
Figure 4D:
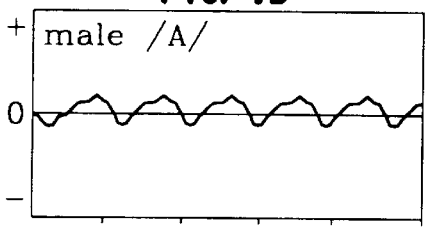
Figure 4E:
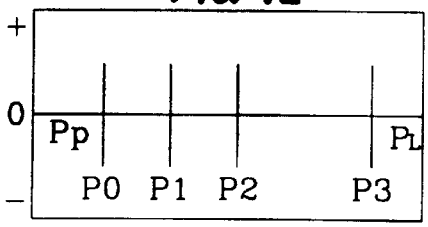
Figure 4F:
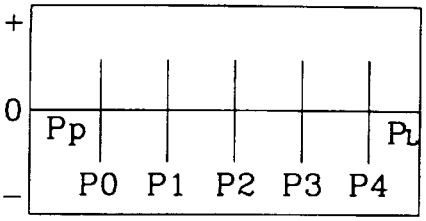
Figure 4G:
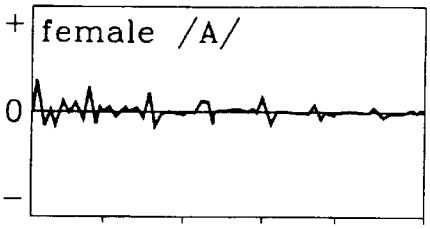
Figure 4H:
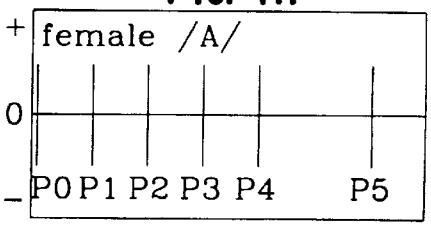
Figure 4I:
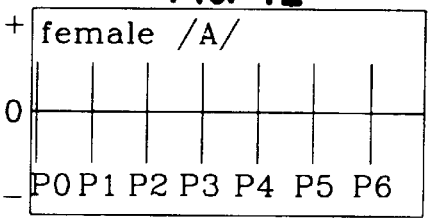
Figure 4J:
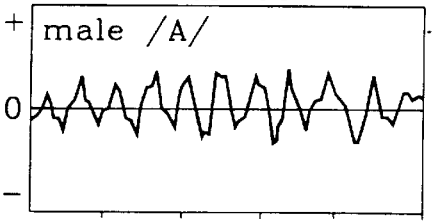
Figure 4K:
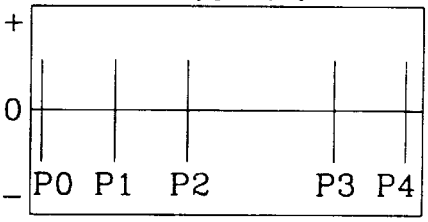
Figure 4L:
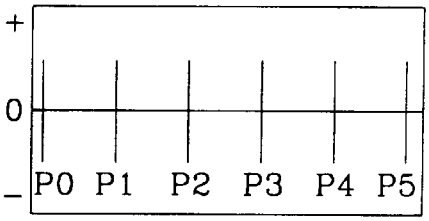

There are examples of cases where the corrected $P_i$ is reinterpolated, and that it is not reinterpolated as shown in FIGS. 4A–4L. The speech waveforms of FIGS. 4A and 4G show that the amplitude level is decreased in the sequential frames. The waveform shown in FIG. 4D shows that the amplitude level is low. The waveform shown in FIG. 4J shows the transition in which the phoneme changes. In these waveforms, since it is difficult to code a signal through the correlation of the signals, the Rp tends to be easily omitted. Consequently, there are many cases that the $P_i$ cannot be clearly extracted. If speech is synthesized using $P_i$ without other countermeasures in these cases, the speech quality can be deteriorated. However, since $P_i$ is corrected and interpolated through the method of the present invention, the IPP is clearly extracted as shown in FIGS. 4C, 4F, 4I and 4L.

An extraction rate AER1 of the IPP is obtained according to formula (10), set forth below, when the cases "$-b_{ij}$" and "$c_{ij}$" are arranged as extracting errors. In the case of "$-b_{ij}$" the IPP is not extracted from the position at which the real IPP exists. In the case of "$c_{ij}$" the IPP is extracted from the position at which the real IPP does not exist.

$$AER1 = \frac{\sum_{j-1}^{m} \sum_{i-1}^{T} [a_{ij} - (|b_{ij}| + c_{ij})]}{\sum_{j-1}^{m} \sum_{i-1}^{T} a_{ij}} \quad (10)$$

Here, $a_{ij}$ is the number of IPPs observed. The variable T is the number of frames in which the IPP exists. The variable m is the number of speech samples.

A result of the experiment according to the present invention, the number of IPPs observed is 3483 in the case of a male speaker, and 5374 in the case of a female speaker. The number of IPPs extracted is 3343 in case of a male speaker, and 4566 in the case of a female speaker. Consequently, the IPP extraction rate is 96% in the case of a male speaker, and 85% in the case of a female speaker.

The pitch extracting methods according to the present invention and the prior art are compared as follows.

According to methods of obtaining an average pitch, such as the autocorrelation method and the Cepstrum method, the error in extracting the pitch occurs at the beginning and the ending of a syllable at a transition of a phoneme, in a frame in which mute and voiced sound exist together, or in a frame in which a voiceless consonant and voiced sound exist together. For example, the pitch is not extracted through the autocorrelation method from the frame in which the voiceless consonant and voiced sound exist together, and the pitch is extracted from the frame having a voiceless sound through the Cepstrum method. As described above, the pitch extracting error is the cause of incorrectly judging a voiced/voiceless sound. Besides, sound quality deterioration can occur since the frame in which a voiceless sound and a voiced sound exist together is utilized as just one of the voiceless and voiced sound sources.

In the method of extracting the average pitch through an analysis of the sequential speech waveform in units of scores of milliseconds, there appears a phenomenon that the pitch interval between the frames gets much wider or narrower than other pitch intervals. In the IPP extracting method according to the present invention, it is possible to manage the pitch interval change, and the pitch position can be clearly obtained even in a frame in which the voiceless consonant and voiced sound exist together.

The pitch extraction rates according to each method based on the speech data of the present invention, are shown in Table 2 below.

TABLE 2

| Section | Autocorrelation method | Cepstrum method | Present invention |
|---|---|---|---|
| Pitch extracting rate (%) in male speech | 89 | 92 | 96 |
| Pitch extracting rate (%) in female speech | 80 | 86 | 85 |

As described above, the present invention provides a pitch extracting method which can manage the pitch change interval caused by the interruption of sound properties or the transition of the sound source. Such a method suppresses the pitch extracting error occurring in an acyclic speech waveform, or at the beginning or ending of speech, or in a frame in which mute and voiced sound, or a voiceless consonant and a voiced sound exist together.

It should be understood that the present invention is not limited to the particular embodiments disclosed herein as the best mode contemplated for carrying out the present invention, but rather the scope of the present invention is defined in the claims appended hereto.

What is claimed is:

1. A method of extracting a speech pitch from a frame of a speech signal in a speech processing unit, comprising:

generating a plurality of residual signals from the speech signal, wherein each generated residual signal indicates one of a high and a low point of the speech signal within the frame; and generating the pitch of the speech signal by selecting one of the generated plurality of residual signals as the pitch, wherein the selected residual signal satisfies a predetermined condition; and wherein generating the plurality of residual signals comprises filtering the speech signal using a finite impulse response (FIR)-STREAK filter.

2. The method according to claim 1, wherein at least one pitch is extracted from each one of a plurality of predetermined frames.

3. The method according to claim 1, wherein generating the plurality of residual signals further comprises:

outputting a result of filtering the speech signal as the residual signal and wherein said FIR-STREAK filter is a combination of a FIR filter and a STREAK filter.

4. The method according to claim 1, wherein generating the pitch of the speech signal comprises selecting as the pitch a residual signal having an amplitude greater than a predetermined value, and having a temporal interval within a predetermined period of time.

5. A method of extracting a pitch from a frame containing a sequential speech signal in a speech processing unit having a finite impulse response (FIR)-STREAK filter which is a combination of a FIR filter and a STREAK filter, the method comprising:

filtering the sequential speech signal of the frame using the FIR-STREAK filter;

generating residual signals from the filtered sequential speech signal, wherein the generated residual signals satisfy a predetermined condition;

interpolating residual signals of the frame other than the generated residual signals of the frame with reference to residual signals of another frame, thereby generating interpolated residual signals; and extracting, as the pitch, one of the generated residual signals and the interpolated residual signals.

6. The method according to claim 5, wherein interpolating residual signals of the frame is performed with reference to residual signals of a preceding frame and a subsequent frame.

7. The method according to claim 5, wherein a signal from among said one of the generated residual signals and said interpolated residual signals is extracted as the pitch, wherein the signal extracted as the pitch has an amplitude larger than a predetermined value and has a temporal interval within a predetermined period of time.

8. The method according to claim 5, wherein at least one pitch is extracted from each one of a plurality of predetermined frames.

* * * * *